US011394135B2

(12) United States Patent
Eremin

(10) Patent No.: US 11,394,135 B2
(45) Date of Patent: Jul. 19, 2022

(54) CONNECTION ELEMENT, ARRANGEMENT AND ENERGY DISTRIBUTION SYSTEM

(71) Applicant: Phoenix Contact GmbH & Co. KG, Blomberg (DE)

(72) Inventor: Sergej Eremin, Herford (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 23 days.

(21) Appl. No.: 17/042,936

(22) PCT Filed: Mar. 22, 2019

(86) PCT No.: PCT/EP2019/057218
§ 371 (c)(1),
(2) Date: Sep. 29, 2020

(87) PCT Pub. No.: WO2019/192858
PCT Pub. Date: Oct. 10, 2019

(65) Prior Publication Data

US 2021/0057828 A1 Feb. 25, 2021

(30) Foreign Application Priority Data

Apr. 3, 2018 (BE) ..... 2018/5220

(51) Int. Cl.
*H01R 4/2483* (2018.01)
*H01R 11/09* (2006.01)

(52) U.S. Cl.
CPC ..... *H01R 4/2483* (2013.01); *H01R 11/09* (2013.01)

(58) Field of Classification Search
CPC .... H01R 4/2483; H01R 11/09; H01R 4/2408; H01R 25/16; H01R 25/161
See application file for complete search history.

(56) References Cited

U.S. PATENT DOCUMENTS 3,129,048 A * 4/1964 Broch ..... H01R 4/2483 439/412
4,793,822 A 12/1988 Cozzens et al.
(Continued)

FOREIGN PATENT DOCUMENTS

AU 2010202134 A1 1/2011
CN 2052963 U 2/1990
(Continued)

*Primary Examiner* — Oscar C Jimenez
*Assistant Examiner* — Paul D Baillargeon
(74) *Attorney, Agent, or Firm* — Leydig, Voit & Mayer, Ltd.

(57) ABSTRACT

A connection element for connecting an insulated electrical conductor includes: a clamping sleeve body in which a receiving space for the electrical conductor is formed; and a connection screw which has a screw head and a screw shaft and is introducible into the receiving space along an insertion direction of the connection screw via an opening formed on the clamping sleeve body. The receiving space has a first region and a second region which adjoins the first region. The first region forms a support region for the conductor and the second region forms a press-in region into which a subregion of the conductor arranged in the first region is pressed by the connection screw in a connected state. The second region has two opposite side walls against which strands of the conductor exposed by pressing in the conductor bear in an electrically contacting manner in the connected state.

13 Claims, 4 Drawing Sheets

(56) References Cited

U.S. PATENT DOCUMENTS

| | | | | | |
|---|---|---|---|---|---|
| 4,964,813 | A | | 10/1990 | Francois et al. | |
| 4,971,573 | A | * | 11/1990 | Pinyan ..... | H01R 4/2475 439/412 |
| 5,102,347 | A | | 4/1992 | Cote et al. | |

FOREIGN PATENT DOCUMENTS

| | | | | | |
|---|---|---|---|---|---|
| CN | 206727248 | U | | 12/2017 | |
| DE | 1982475 | U | | 4/1968 | |
| DE | 6926918 | U | | 11/1969 | |
| FR | 1000882 | A | | 2/1952 | |
| FR | 2459560 | A1 | | 1/1981 | |
| FR | 2787933 | A1 | | 6/2000 | |
| FR | 2848731 | A1 | * | 6/2004 | ..... H01R 4/2483 |
| GB | 1198797 | A | | 7/1970 | |

* cited by examiner

CONNECTION ELEMENT, ARRANGEMENT AND ENERGY DISTRIBUTION SYSTEM

CROSS-REFERENCE TO PRIOR APPLICATIONS

This application is a U.S. National Phase application under 35 U.S.C. § 371 of International Application No. PCT/EP2019/057218, filed on Mar. 22, 2019, and claims benefit to Belgian Patent Application No. BE 2018/5220, filed on Apr. 3, 2018. The International Application was published in German on Oct. 10, 2019 as WO 2019/192858 under PCT Article 21(2).

FIELD

The invention relates to a connection element for connecting an insulated electrical conductor, wherein the connection element comprises a clamping sleeve body in which a receiving space for the electrical conductor is formed, and a connection screw which has a screw head and a screw shaft and can be introduced along an insertion direction of the connection screw into the receiving space via an opening which is formed on the clamping sleeve body. The invention also relates to an arrangement having an insulating material housing and at least one corresponding connection element, and to an energy distribution system having a plurality of correspondingly designed arrangements arranged one behind the other.

BACKGROUND

Connection elements which comprise a clamping sleeve body and a connection screw usually serve to clamp a stripped conductor in an electrically contacting manner. For this purpose, the stripped conductor is inserted into the receiving space of the clamping sleeve body, wherein the receiving space extends with its longitudinal extent transversely to the longitudinal extent of the opening for introducing the connection screw. In the connected state, the connection screw is introduced into the receiving space to such an extent that it exerts a compressive force on the stripped conductor positioned in the receiving space and thus forms an electrical contacting between the exposed strands of the conductor and the connection screw and also the clamping sleeve body. In this case, the connection screw should be formed from a material having good electrical conductivity.

SUMMARY

In an embodiment, the present invention provides a connection element for connecting an insulated electrical conductor, comprising: a clamping sleeve body in which a receiving space for the electrical conductor is formed; and a connection screw which has a screw head and a screw shaft and is introducible into the receiving space along an insertion direction of the connection screw via an opening formed on the clamping sleeve body, wherein the receiving space has a first region and a second region which adjoins the first region, wherein the first region forms a support region for the conductor and the second region forms a press-in region into which a subregion of the conductor arranged in the first region is pressed by the connection screw in a connected state, and wherein the second region has two opposite side walls against which strands of the conductor exposed by pressing in the conductor bear in an electrically contacting manner in the connected state.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
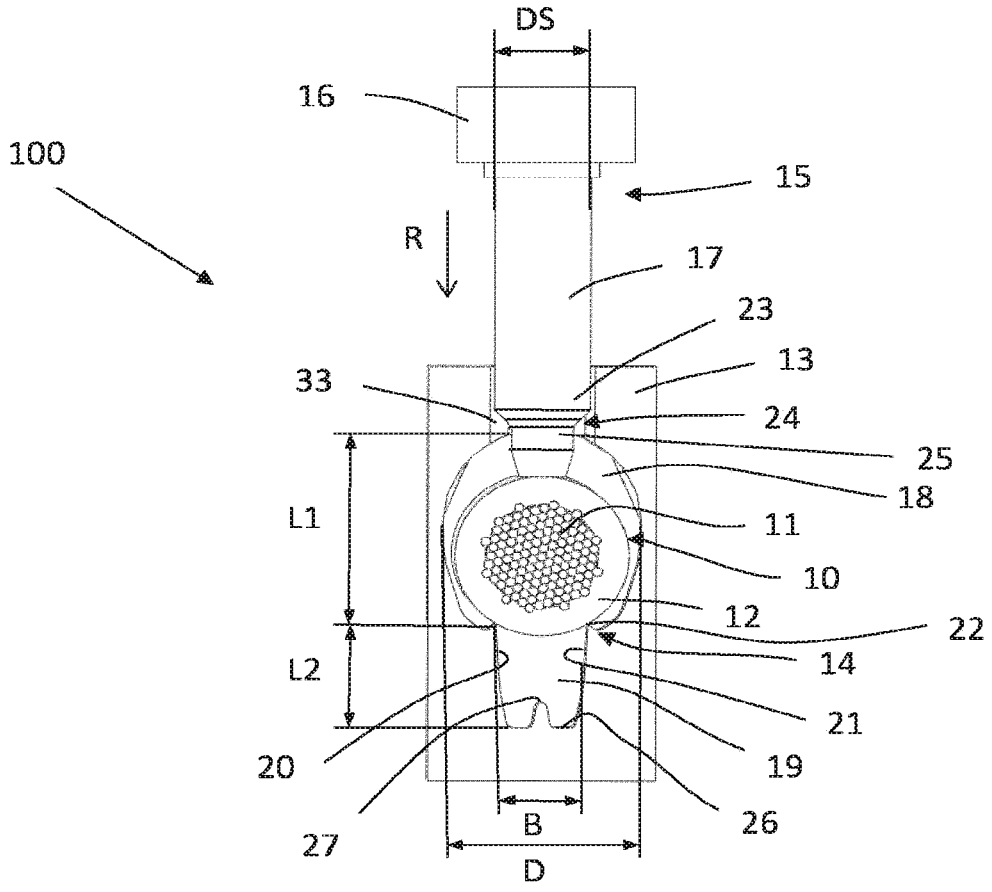
FIG. 1 a schematic sectional view of a connection element according to the invention with an introduced, unconnected conductor, FIG. 2 a schematic sectional view of the connection element shown in FIG. 1 with the introduced conductor in a connected state, FIG. 3 a schematic illustration of a clamping sleeve body, FIG. 4 a schematic illustration of a connection element according to the invention with a contact element arranged on the clamping sleeve body, FIG. 5 a schematic sectional view of an arrangement according to the invention, FIG. 6 a schematic sectional view of an arrangement with a partially open end cap, and FIG. 7 a schematic representation of an energy distribution system according to the invention.

In an embodiment, the present invention provides a connection element, an arrangement and an energy distribution system, with which insulated conductors, which are not stripped, can also be reliably contacted.

The connection element according to the invention is characterized in that the receiving space has a first region and a second region which adjoins the first region, wherein the first region forms a support region for the conductor and the second region forms a press-in region, into which a subregion of the conductor which is arranged in the first region is pressed by means of the connection screw in a connected state, wherein the second region has two opposite side walls, against which strands of the conductor exposed by pressing in the conductor bear in an electrically contacting manner in the connected state.

The receiving space provided in the clamping sleeve body for receiving the insulated conductor to be connected is now designed in such a way that it is formed from two regions. A first region serves for the actual support of the conductor, which is inserted into the receiving space and which is insulated and thus precisely not stripped. In the unconnected state of the conductor, the conductor is only positioned in this first region. A second region of the receiving space adjoins this first region in the insertion direction of the connection screw, wherein the first region transitions into the second region. The second region forms a press-in region into which the conductor positioned in the first region is pressed partially or in some areas into this second region when being connected by means of the connection screw, so that, in the connected state of the conductor, a first subregion of the conductor is positioned in the first region of the receiving space and a second subregion of the conductor is positioned in the second region of the receiving space. By pressing the conductor into the second region, the insulating material jacket surrounding the strands of the insulated conductor is at least in some areas sheared off, so that, in the subregion of the conductor pressed into the second region, the strands are exposed at least in some areas. The insulating material jacket is sheared off at the region of the subregion of the conductor which lies adjacent to the opposite side walls of the second region of the receiving space, so that the strands of the conductor exposed there by the shearing can bear in an electrically contacting manner against such side walls of the second region of the receiving space in the connected state. The connected conductor is thus preferably electrically contacted in the second region of the receiving space and preferably between the clamping sleeve body and the strands of the conductor exposed by the shearing, so that contacting between the strands of the conductor and the connection screw is not absolutely necessary, as a result of which the connection screw may also be formed from a material that is less conductive and thus less expensive. The insulating material jacket of the conductor is preferably sheared off at a peripheral edge formed in the transition region between the first region and the second region, wherein the edge may preferably be of sharp-edged design. The jacket of the conductor is preferably sheared off in a targeted manner at two opposite side surfaces of the conductor, which then respectively bear against one of the two side walls of the second region of the receiving space in a contacting manner. At the remaining region of the conductor, the strands are preferably still surrounded by the insulating material jacket in the connected state.

The first region and the second region of the receiving space preferably have different shapes, in order to be able to form a respectively optimally shaped support region and press-in region. Preferably, the first region has a round cross section and/or the second region has an elongated cross section. With its diameter extending transversely to the insertion direction of the connection screw, the first region is in this case preferably wider than the second region. If the first region has a round cross section, optimal support of the conductor in the receiving region is ensured, since the shape of the first region is adapted to the round cross-sectional shape of the conductor. In contrast, the second region is preferably not round but preferably has an elongated shape, so that the second region may be formed in the shape of a groove or a gap. Due to the elongated shape, which additionally preferably has a smaller width than the first region, the pressing-in of the conductor and the resulting shearing of the insulating material jacket from the strands of the conductor can be carried out in a safe and targeted manner.

In order to be able to further improve the contacting of the conductor, the second region may have, at its base section opposite the first region, a projection protruding into the second region. As a result of the projection protruding into the second region, when the subregion of the conductor is pressed into the second region, such subregion can be compressed more strongly and the exposed strands of the conductor can be pressed with a higher force in the direction of the side walls of the second region of the receiving space, so that, in the connected state, the contact force of the strands bearing against the side walls of the second region can be increased. The projection is preferably arranged centrally to the base section, so that a uniform force distribution in the direction of the two side walls of the second region can take place. The projection is preferably of web-shaped design and may extend over the entire depth of the base section transversely to the insertion direction of the connection screw.

The first region may have a length L1 extending in the insertion direction of the connection screw, and the second region may have a length L2 extending in the insertion direction of the connection screw, wherein preferably L2≥½ L1. The second region preferably has a length L2 which corresponds to ¾ of the length L1 of the first region. Due to the relatively long design of the second region in relation to the first region, the subregion of the conductor which is pressed into the second region of the receiving space can be pressed even more compactly, so that the exposed strands can be pressed even more strongly in the direction of the side walls of the second region and the contact force between the side walls of the second region and the exposed strands can thereby be further increased.

The shearing of the insulating material jacket from the strands when the subregion of the conductor is pressed into the second region can be further improved in that the screw shaft of the connection screw has a diameter which is smaller than a width of the second receiving space extending transversely to the insertion direction of the connection screw. Due to the smaller diameter, the shearing effect can be increased in particular at the edge at the transition region between the first and the second region and also at the side walls of the second region, as a result of which shearing of the insulating material jacket from the strands of the conductor can be facilitated and can thereby take place in a particularly good and defined manner in these areas.

At its end section opposite the screw head, the screw shaft may have a region tapering in the insertion direction of the connection screw. The end section of the screw shaft may thus have a tip which can drill into the conductor when the conductor is being connected and thus when the connection screw is being moved in the insertion direction. When the connection screw is being screwed in, the conductor positioned in the first region can thereby first be pressed and displaced in the direction of the inner peripheral surface of the first region, so that the conductor with its insulating material jacket presses against the inner peripheral surface of the first region. If the connection screw is moved further in the insertion direction, due to the tapering region of the end section of the connection screw, the strands can first be compressed within the insulating material jacket and can thereby be pressed into the second region particularly compactly and with a high force. Due to the tapering region, the strands exposed by the resulting shearing can then be displaced in an even more targeted basis in the direction of the side walls of the second region, in order to be able to achieve the exposed strands bearing with particularly good contacting against the side walls of the second region.

The tapering region may preferably have at least two stepped shoulders. The stepped shoulders preferably each extend around the entire circumference of the end section of the screw shaft. As a result of the shoulders, the strands of the conductor coming into contact with the end section of the conductor can be held in place on the shoulders when the conductor is being connected and can thus be taken along in the insertion direction of the connection screw when the connection screw is being screwed in further, whereby the strands bearing against the side walls of the second region can again be pressed more strongly against the side walls of the second region, so that the contact force acting there can be further increased. The pressing-in of the conductor into the second region can thus be improved by the stepped shoulders.

Furthermore, it may preferably be provided that the two opposite side walls of the second region of the receiving space are designed to extend at an angle to one another. The side walls thus preferably do not extend in parallel to one another but rather may extend at an angle >0° to one another. In this case, the side walls preferably extend in relation to one another in such a way that they extend toward one another in the direction of the base section of the second region. As a result of the side walls extending at an angle to one another, the pressing-in of the subregion of the conductor into the second region can be further improved and the exposed strands can also be pressed against the side walls of the second region with an even higher contact force.

A slot-shaped recess may furthermore be formed on each of the two opposite side walls of the second region. When the subregion of the conductor is being pressed in, the exposed strands bearing against the side walls can be partially pressed into these recesses, as a result of which the bearing force and thus the contact force of the strands at the side walls can be further increased and the electrical contacting can thus also be further improved.

A receiving region on which a contact element may be arranged may be formed on the clamping sleeve body. Via this contact element, a device can, for example, be connected to the connection element in an electrically contacting manner. The receiving region may have bores, for example, in which the contact element can be fastened in order to be able to form an electrical contacting between the clamping sleeve body and the contact element. The contact element can, for example, be pressed into these bores. Further fastenings of the contact element to the clamping sleeve body are likewise conceivable. The contact element may be designed as a tulip contact, for example.

The object according to the invention is also achieved by means of an arrangement which has an insulating material housing, in which at least one connection element formed and developed as described above is arranged, wherein the insulating material housing has, for each connection element, at least two opposite feedthrough openings for the passage of the conductor arranged in the respective connection element. The arrangement may preferably have a plurality of connection elements which are arranged next to one another and may be arranged within the insulating material housing.

It may preferably be provided that an end cap is arranged at at least one of the two opposite feedthrough openings and may have, for each connection element, a boundary wall for the conductor passed through the feedthrough opening. The end cap may close the insulating material housing on one side, so that an end section of a conductor is arranged in the insulating material housing in a touch-safe manner. For this purpose, the end cap may have a boundary wall which can cover the open cross section of the end section of the conductor. The end cap may be formed integrally with the insulating material housing, for example. However, it is also possible for the end cap to be a part which is separate from the insulating material housing and may, for example, be fastened as required to the insulating material housing by means of a latching connection. The end cap, like the insulating material housing, is preferably formed from a plastic material. The end cap may, for example, be designed such that it extends over and covers all feedthrough openings of one side of the insulating material housing.

However, if a longer conductor is to be positioned in the arrangement, the end cap may be designed such that the boundary wall of the end cap has a perforation for opening the boundary wall. At the perforation, a user can easily open the boundary wall by means of a knife, if necessary, in order to pass a conductor through the end cap.

In an embodiment, the present invention provides an energy distribution system which has a plurality of arrangements which are arranged one behind the other and at a distance from one another along the length of at least one electrical conductor, wherein the arrangements may be formed and developed as described above.

FIG. 1 shows a sectional view of a connection element 100 with a conductor 10 which is introduced into the connection element 100 and is not yet connected in an electrically contacting manner in FIG. 1. The conductor 10 is an insulated conductor 10 with which the strands 11 are enclosed by an insulating material jacket 12.

The connection element 100 has a clamping sleeve body 13 in which a receiving space 14 for the conductor 10 is formed. In order to connect the conductor 10, it is inserted into this receiving space 14, as can be seen in FIG. 1. The clamping sleeve body 13 is formed of an electrically conductive metal material.

The connection element 100 furthermore has a connection screw 15 which has a screw head 16 and a screw shaft 17 and can be introduced into the receiving space 14 along an insertion direction R via an opening 33 formed on the clamping sleeve body 13.

Figure 2:
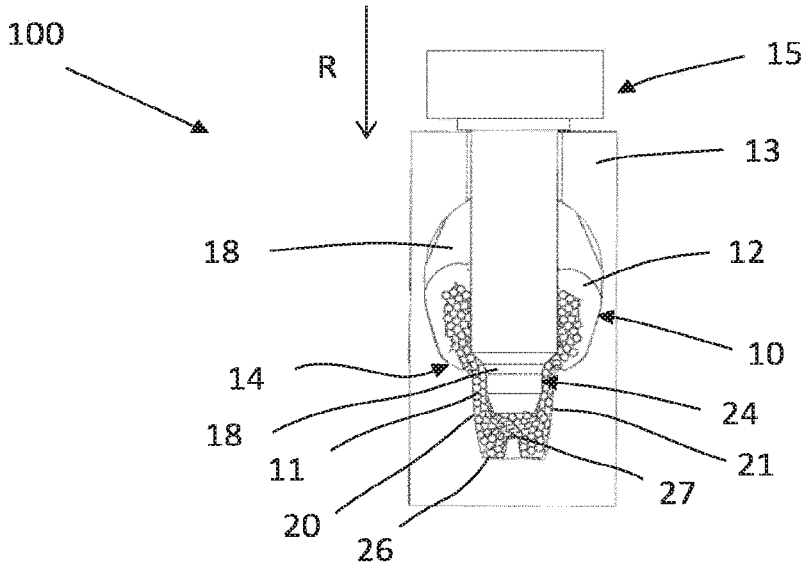

The receiving space 14 is formed of a first region 18 and a second region 19 which adjoins the first region 18. The first region 18 forms a support region in which the conductor 10 is positioned, in particular in the unconnected state, as shown in FIG. 1. The first region 18 has a round or oval cross section, so that the shape of the first region 18 is adapted to the outer contour of the round conductor 10. The second region 19 forms a press-in region into which a subregion of the conductor 10 arranged in the first region 18 is pressed by means of the connection screw 15 in a connected state as shown in FIG. 2. When the conductor 10 is pressed into the first region, a part of the insulating material jacket 12 is sheared off the strands 11, so that, in the connected state, the exposed strands 11 bear against two opposite side walls 20, 21 of the second region 19 of the connection space 14 in an electrically contacting manner. In contrast to the first region 18, the second region 19 has an elongated cross section, so that the width B of the second region 19 is smaller than its length L2 and also smaller than the diameter D of the first region 18. In the embodiment shown here, the length L2 of the second region 19 is greater than half of the length L1 of the first region 18, so that the second region 19 forming the press-in region is elongated.

In the transition region between the first region 18 and the second region 19, a peripheral edge 22 is formed, which brings about the shearing of the insulating material jacket 12 from the strands 11 when the conductor 10 is pressed into the second region 19. The edge 22 may be of sharp-edged design.

In order to improve the shearing of the insulating material jacket 12 from the strands 11 when pressing a subregion of the conductor 10 from the first region 18 into the second region 19, the screw shaft 17 has a diameter DS which is smaller than the width B of the second region 19 of the receiving space 14. The shearing forces acting on the conductor 10 during pressing-in can be increased by the diameter DS of the screw shaft which is smaller in comparison to the width B of the second region 19.

On its end section 23 opposite the screw head 16, the screw shaft 17 has a region 24 which tapers in the insertion direction R of the connection screw 15. The screw shaft 17 thus has a cross-section reduction at its end section 23. As a result of this cross-section reduction, the force, exerted on the conductor 10 by means of the connection screw 15, for connecting the conductor 10 can be increased. The conductor 10 is initially compressed by the tapering region 24, which comes into direct contact with the conductor 10 when the conductor 10 is being connected, whereby the strands 11 are displaced outward, so that after the insulating material jacket 12 has been sheared off, the exposed strands 11 are pressed outward in the direction of the side walls 20, 21, so that a high contact force can be formed between the exposed strands 11 and the side walls 20, 21.

In the embodiment shown here, the tapering region 24 has a plurality of stepped shoulders 25. The strands 11 of the conductor 10 coming into contact with the end section 23 of the conductor 10 when the conductor 10 is being connected are held in place on the shoulders 25 and can thus be taken along in the insertion direction R of the connection screw 15 when the connection screw 15 is being screwed in further, whereby the strands 11 bearing against the side walls 20, 21 of the second region 19 can again be pressed more strongly against the side walls 20, 21, so that the contact force acting there can be further increased. In the embodiment shown here, the stepped shoulders 25 have different heights.

As can be seen in FIGS. 1 and 2, the two side walls 19, 20 of the second region 19 do not extend in parallel to one another, but are designed to extend at an angle to one another, so that they are arranged at an angle greater than 0° to one another. In this case, the side walls 19, 20 extend toward one another in the direction of a base section 26 of the second region 19, so that the second region 19 tapers in the direction of its base section 26.

A projection 27 protruding into the second region 19 is formed on the base section 26 and is formed here in the shape of a bulge extending away from the base section 26. The projection 27 is arranged centrally to the width B of the second region 19. The projection 27 is preferably of web-shaped design and may extend over the entire depth of the base section 26. As a result of the projection 27 protruding into the second region 19, when the subregion of the conductor 10 is pressed into the second region 19, this subregion can be compressed more strongly and the exposed strands 11 of the conductor 10 can be pressed more strongly in the direction of the side walls 20, 21, so that the contact force of the strands 11 bearing against the side walls 20, 21 of the second region 19 can be increased.

Figure 3:
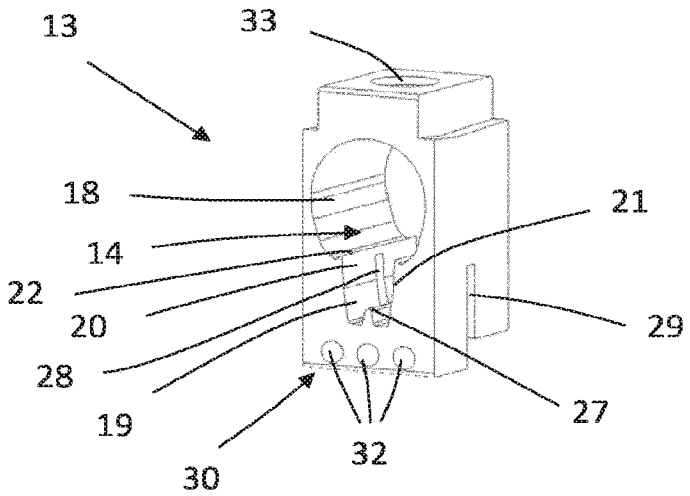

FIG. 3 shows an embodiment of a clamping sleeve body 13 with which a slot-shaped recess 28, 29 is formed on each of the two opposite side walls 20, 21 of the second region 19. Here, the two slot-shaped recesses 28, 29 are arranged centrally along the depth of the second region 19 which is formed transversely to the insertion direction R of the connection screw 15. The slot-shaped recesses 28, 29 furthermore extend over the entire length L2 of the second region 19 in the embodiment shown here. The exposed strands 11 pressed against the side walls 20, 21 can dip into these slot-shaped recesses 28, 29, so that the contact force acting between the side walls 20, 21 and the strands 11 can be increased.

Figure 4:
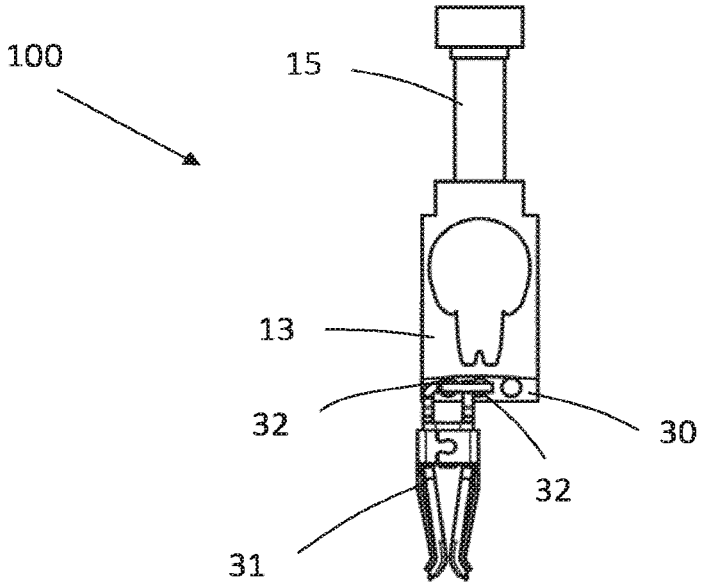

As can also be seen in FIG. 3, on the clamping sleeve body 13 may be formed a receiving region 30 on which a contact element 31 may be arranged, as shown in FIG. 4. The receiving region 30 has a plurality of bores 32, here three bores 32, in which the contact element 31 may be mounted. In the embodiment shown in FIG. 4, the contact element 31 is held pressed into two of the bores 32. The contact element 31 is designed as a tulip contact.

Figure 5:
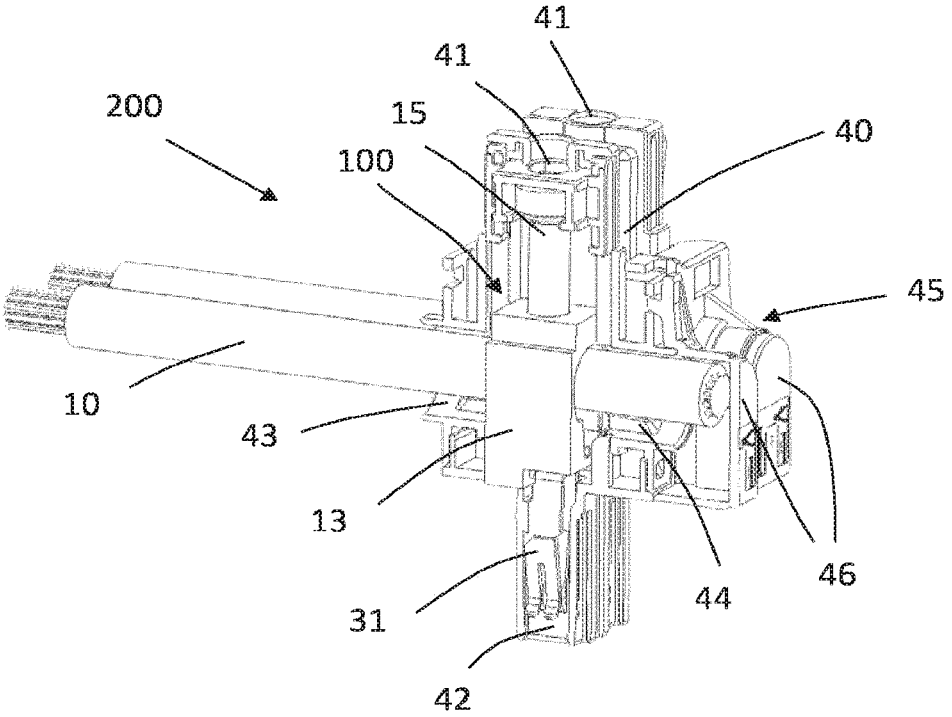

FIG. 5 shows a sectional view through an arrangement 200 with which a plurality of connection elements 100 as shown in FIGS. 1 to 4 are arranged next to one another in an insulating material housing 40, so that a plurality of conductors 10 may be connected next to one another in an electrically contacting manner. The insulating material housing 40 is formed in such a way that it encloses the clamping sleeve body 13, the connection screw 15 and the contact element 31 of a respective connection element 100. For actuating the connection screw 15, an opening 41 for each connection element 100 is formed on the insulating material housing 40. For contacting the contact element 31, an opening 42 for each connection element 100 is likewise formed on the insulating material housing 40. The insulating material housing 40 furthermore has, for each connection element 100, two opposite feedthrough openings 43, 44, through which the conductor 10 to be connected is passed.

In the embodiment shown in FIG. 5, an end cap 45 is arranged at the feedthrough openings 44 of one side of the insulating material housing 40 and covers all feedthrough openings 44 on such side of the insulating material housing 40. The end cap 45 has, for each connection element 100, a boundary wall 46 for the conductor 10 passed through the feedthrough opening 44. The end cap 45 forms a touch-safety device for the end section of a conductor 10.

Figure 6:
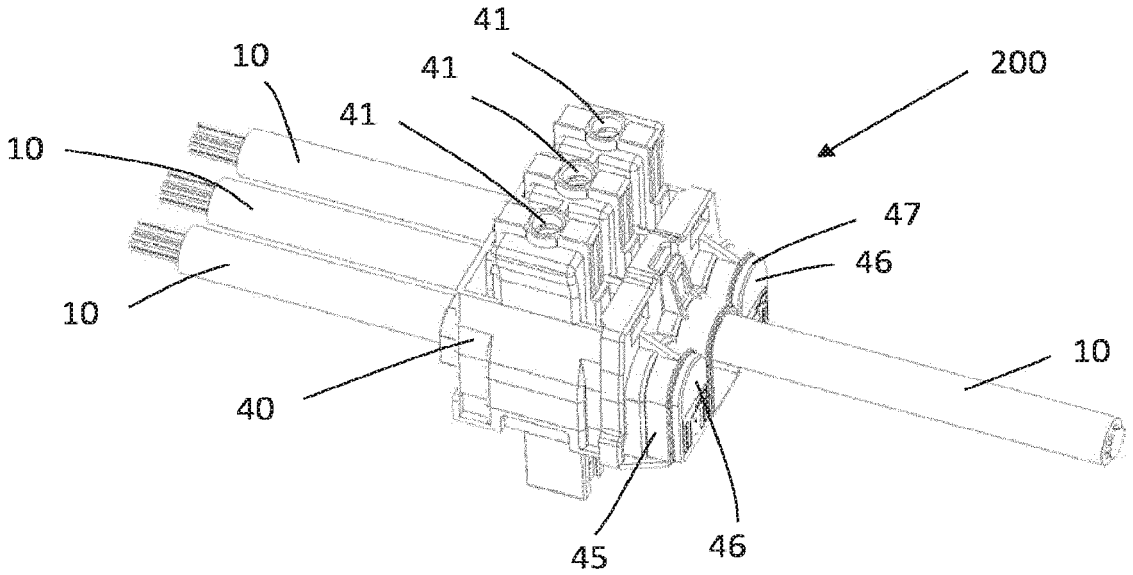

Each boundary wall 46 may have a perforation 47 for opening the boundary wall 46, so that, as shown in FIG. 6, a longer conductor 10 may be passed through the end cap 45 and thus protrude therefrom. At the perforation 47, a user can easily open the boundary wall 46 by means of a knife, if necessary, in order to be able to pass a conductor 10 through the end cap 45.

Figure 7:
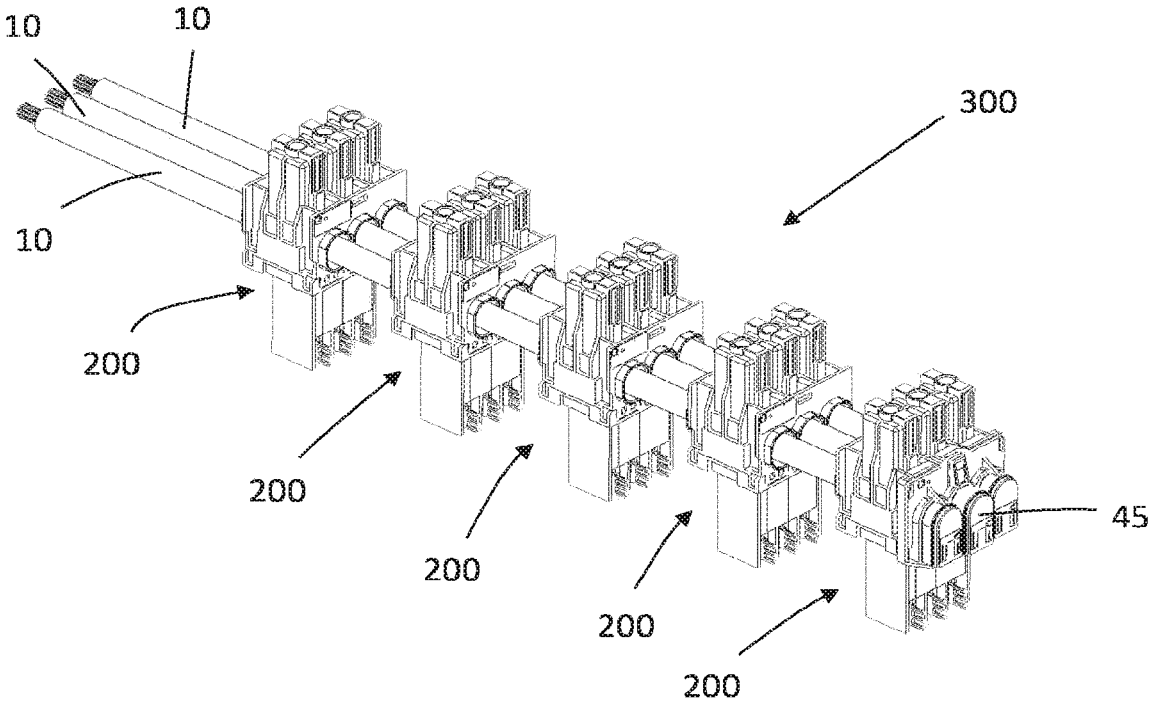

FIG. 7 also shows an energy distribution system 300 with which a plurality of arrangements 200 are arranged one behind the other, wherein the conductors 10 arranged next to one another extend through the plurality of arrangements 200 and each conductor 10 is connected to the arrangements 200 in an electrically contacting manner, so that a multi-tap is formed for each conductor 10. On one of its sides, the last arrangement 200 has an end cap 45 in order to cover the end section of the conductors 10. In the other arrangements 200, no such end cap 45 is arranged, but the conductors 10 extend through the arrangements 200 to the adjacent arrangement 200.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

Connection element 100
Conductor 10
Strands 11
Insulating material jacket 12
Clamping sleeve body 13
Receiving space 14
Connection screw 15
Screw head 16
Screw shaft 17
First region 18
Second region 19
Side wall 20
Side wall 21
Edge 22
End section 23
Tapering region 24
Stepped shoulder 25
Base section 26
Projection 27
Slot-shaped recess 28
Slot-shaped recess 29
Receiving region 30
Contact element 31
Bore 32
Opening 33
Arrangement 200
Insulating material housing 40
Opening 41
Opening 42
Feedthrough opening 43
Feedthrough opening 44
End cap 45
Boundary wall 46
Perforation 47
Energy distribution system 300
Insertion direction of the connection screw R
Length of the first region L1
Length of the second region L2
Width of the second region B
Diameter of the first region D
Diameter of the screw shaft DS

The invention claimed is:

1. A connection element for connecting an insulated electrical conductor, comprising:

a clamping sleeve body in which a receiving space for the electrical conductor is formed; and a connection screw which has a screw head and a screw shaft and is introducible into the receiving space along an insertion direction of the connection screw via an opening formed on the clamping sleeve body, wherein the receiving space has a first region and a second region which adjoins the first region, wherein the first region forms a support region for the conductor and the second region forms a press-in region into which a subregion of the conductor arranged in the first region is pressed by the connection screw in a connected state, wherein the second region has two opposite side walls against which strands of the conductor exposed by pressing in the conductor bear in an electrically contacting manner in the connected state, wherein the screw shaft has, on an end section thereof opposite the screw head, a tapering region which tapers in the insertion direction of the connection screw, and wherein the tapering region has at least two stepped shoulders.

2. The connection element according to claim 1, wherein the first region has a round cross section and/or the second region has an elongated cross section.

3. The connection element according to claim 1, wherein the second region has, on a base section thereof opposite the first region, a projection protruding into the second region.

4. The connection element according to claim 1, wherein the first region has a length L1 extending in the insertion direction of the connection screw and the second region has a length L2 extending in the insertion direction of the connection screw, and wherein L2 ≥½ L1.

5. The connection element according to claim 1, wherein the screw shaft of the connection screw has a diameter which is smaller than a width of the second region of the receiving space extending transversely to the insertion direction of the connection screw.

6. The connection element according to claim 1, wherein the two opposite side walls of the second region of the receiving space extend at an angle to one another.

7. The connection element according to claim 1, wherein a slot-shaped recess is formed on each of the two opposite side walls.

8. The connection element according to claim 1, wherein a receiving region on which a contact element is arranged is formed on the clamping sleeve body.

9. The connection element according to claim 8, wherein the contact element comprises a tulip contact.

10. An arrangement, comprising:

an insulating material housing in which at least one connection element according to claim 1 is arranged, wherein the insulating material housing has, for each connection element, at least two opposite feedthrough openings for the passage of the conductor arranged in the respective connection element.

11. The arrangement according to claim 10, wherein an end cap is arranged at at least one of the two opposite feedthrough openings and has, for each connection terminal, a boundary wall for the conductor passed through the feedthrough opening.

12. The arrangement according to claim 11, wherein the boundary wall has a perforation for opening the boundary wall.

13. An energy distribution system, comprising:

a plurality of arrangements of claim 10, which arrangements are arranged one behind the other and at a distance from one another along a length of at least one electrical conductor.

* * * * *